US005226374A

United States Patent [19]

Yamagishi et al.

[11] Patent Number: 5,226,374

[45] Date of Patent: Jul. 13, 1993

[54] METHOD OF CONTROLLING COMBUSTION OF FLUIDIZED-BED INCINERATOR

[75] Inventors: Miki Yamagishi; Takashi Yokoyama; Yasuo Suzuki; Haruhito Tsuboi; Takashi Noto; Masaaki Kawakami, all of Tokyo, Japan

[73] Assignee: NKK Corporation, Tokyo, Japan

[21] Appl. No.: 777,325

[22] PCT Filed: Mar. 27, 1991

[86] PCT No.: PCT/JP91/00399

§ 371 Date: Nov. 25, 1991

§ 102(e) Date: Nov. 25, 1991

[87] PCT Pub. No.: WO91/14915

PCT Pub. Date: Oct. 3, 1991

[30] Foreign Application Priority Data

Mar. 27, 1990 [JP] Japan ..... 2-77382
Oct. 3, 1990 [JP] Japan ..... 2-263778

[51] Int. Cl.[5] ..... F23G 3/00; F23G 5/00

[52] U.S. Cl. ..... 110/346; 110/245; 110/101 CF

[58] Field of Search ..... 110/245, 162, 101 CF, 110/101 R, 346

[56] References Cited

U.S. PATENT DOCUMENTS

| | | | |
|---|---|---|---|
| 3,057,308 | 10/1962 | Knipping . | |
| 4,416,418 | 11/1983 | Goodstine et al. | 110/245 |
| 4,552,203 | 11/1985 | Chrysostowe et al. | 110/245 |
| 4,628,838 | 12/1986 | Love | 110/245 |
| 4,986,198 | 1/1991 | Naito et al. | 110/245 |
| 5,020,451 | 6/1991 | Maebo et al. | 110/189 |
| 5,060,584 | 10/1991 | Sowards et al. | 110/235 |
| 5,101,742 | 4/1992 | Sowards et al. | 110/245 |
| 5,138,958 | 8/1992 | Sinquin et al. | 110/346 |

FOREIGN PATENT DOCUMENTS

| | | |
|---|---|---|
| 0358760 | 3/1990 | European Pat. Off. . |
| 53-148165 | 12/1978 | Japan . |
| 54-86973 | 7/1979 | Japan . |
| 57-184920 | 11/1982 | Japan . |
| 60-57523 | 12/1985 | Japan . |
| WO88/08504 | 11/1988 | World Int. Prop. O. . |

OTHER PUBLICATIONS

Patent Abstracts of Japan, vol. 10, No. 278, Sep. 1986; & JP-A-61 100 612 (Ebara Corp.) Abstract.

*Primary Examiner*—Henry C. Yuen

*Attorney, Agent, or Firm*—Frishauf, Holtz, Goodman & Woodward

[57] ABSTRACT

The present invention discloses a method of controlling combustion of a fluidized-bed incinerator. In a fluidized-bed incinerator (5), a method of controlling combustion of the fluidized-bed incinerator comprises measuring a supply rate of incineration waste by a supply rate measuring unit (11) using a photoelectric element (1) arranged on a shoot (2) for supplying incineration waste (3) from a dust feeder (4) to the incinerator (5), and when the supply rate of incineration waste is higher than a predetermined value, decreasing a supply rate of incineration waste of the dust feeder 4 to suppress a combusting operation, increasing an induced gas rate of an exhaust gas induced blower (9) of the incinerator to suppress an increase in an incinerator internal pressure decreasing a flow rate of fluidizing air of a forcing blower (7) to suppress a combusting operation, or increasing a flow rate of a blower (8) for supplying air to a free board portion to prevent production of an unburnt gas.

16 Claims, 6 Drawing Sheets

METHOD OF CONTROLLING COMBUSTION OF FLUIDIZED-BED INCINERATOR

TECHNICAL FIELD

The present invention relates to a method of controlling combustion of a fluidized-bed incinerator.

BACKGROUND ART

As shown in FIG. 9, in a fluidized-bed incinerator 5, fluidized sand of a fluidized bed 6 constituted by the fluidized sand circularly supplied to the lower portion of the incinerator is preheated to a temperature of about 100° C., and fluidizing air 16 allows the sand to flow. In this state, combustion materials supplied from a charge shoot 2 are combusted for a short time. An unburnt gas on the fluidized bed 6 is combusted by secondary air 15 supplied to a free board portion 13, and a combustion exhaust gas 14 is exhausted from a top portion of the incinerator 5.

Incombustibles contained in the combustion materials are exhausted from the bottom portion of the incinerator together with the fluidized sand. The fluidized sand is separated from the incombustibles and recycled in the incinerator.

In order to control a combustion state of the fluidized-bed incinerator, as is disclosed in Published Unexamined Japanese Patent Application No. 53-14865, the following method is employed. That is, an oxygen concentration in exhaust gas is detected to control a supply rate of combustion materials such as garbage.

A combustion state in an incinerator is determined by brightness or the like in the incinerator. For example, when the combustion becomes strong, a fluidizing air flow rate is decreased to cause the combustion to be weak. This method is disclosed in PCT WO88/8504.

PROBLEM TO BE SOLVED BY THE INVENTION

For example, when a large amount of waste is charged into an incinerator from a charge shoot at one time, since a combusting operation is performed for a short time, e.g., several seconds, a large amount of unburnt gas may be generated for a lack of combustion air. The large amount of unburnt gas is exhausted out of the incinerator without being completely combusted even on a free board portion. The exhaust gas has a low oxygen concentration and contains harmful gases such as CO gas, thereby causing environmental pollution.

In this case, even when the operation of the incinerator is controlled by measuring the oxygen concentration of the exhaust gas, an oxygen concentration meter available at present measures an oxygen concentration to have a time lag of several ten seconds. Therefore, the meter cannot respond to a change in combustion state within a short period of time.

When a combustion state in an incinerator is determined by brightness in the incinerator, a time lag is smaller than that caused when the combustion state is controlled by measuring an oxygen concentration. However, since the combustion state is determined after combustion materials are combusted, the incineration cannot always be stably controlled.

It is an object of the present invention to provide a method of controlling combustion of a fluidized-bed incinerator so as to solve the above problem.

DISCLOSURE OF INVENTION

According to the present invention, in a fluidized-bed incinerator, a method of controlling combustion of a fluidized-bed incinerator comprises measuring a waste supply rate by a supply rate measuring unit using a photoelectric element arranged on a shoot for supplying incineration waste from a dust feeder to the incinerator, and when the incineration waste supply rate is higher than a predetermined value, decreasing the supply rate of the incineration waste of the dust feeder to suppress a combusting operation.

An induced gas flow rate of an exhaust gas induced blower of the incinerator is increased to limit an increase in incinerator internal pressure.

An air flow rate of fluidizing air of a forcing blower is decreased to suppress a combustion operation.

An air flow rate of a blower for supplying air to a free board portion is increased to prevent production of unburnt gases.

A flow rate of the fluidizing air is instantaneously decreased, and at the same time, air is supplied to the free board portion at a flow rate corresponding to the decrease, thereby suppressing a combusting operation and preventing production of unburnt gases.

Alternatively, a combusting operation of a fluidized-bed incinerator is controlled by a combination of two or more of the above control operations.

FUNCTION

Since the waste supply rate is measured by the supply rate measuring unit arranged on the shoot for supplying incineration waste to the incinerator, the waste supply rate of can be instantaneously measured before the waste is supplied to the incinerator. Therefore, an appropriate control operation can be performed in accordance with an incineration combustion state changed by a change in supply rate of the waste.

Especially, when a signal from the supply rate measuring unit exceeds a predetermined value, fluidizing air is instantaneously decreased, and at the same time, air is supplied to the free board portion at a flow rate corresponding to the decrease to rapidly suppress a combusting operation. On the other hand, unburnt matter produced with the decrease in fluidizing air is combusted in the free board portion to prevent generation of unburnt matter, thereby performing a stable combustion control operation of the fluidized-bed incinerator.

EMBODIMENTS

Figure 1:
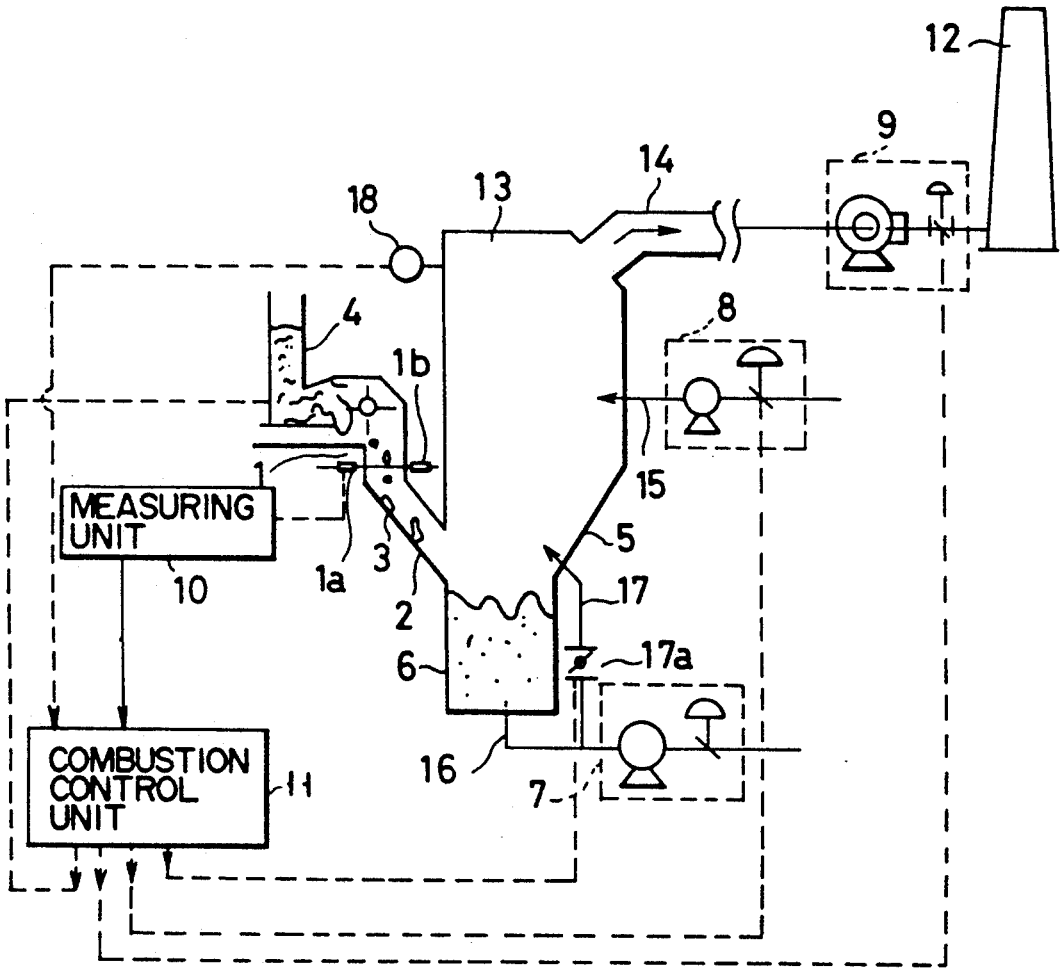
FIG. 1 is a view for explaining an arrangement of a unit for embodying a method according to the present invention.

An application of the first embodiment of the present invention to a fluidized-bed municipal-waste incineration plant will be described below with reference to the accompanying drawings.

A photoelectric element 1 for detecting a supply rate of combustion materials is mounted on a charge shoot 2 for waste 3 between a dust feeder 4 and an incinerator 5. As the photoelectric element 1, e.g., a transmission photoelectric switch constituted by a light-emitting portion la and a light-receiving portion lb is used.

A detection signal from the photoelectric element 1 is arithmetically processed by a measuring unit 10 in accordance with a method disclosed in, e.g., Japanese Patent Application No. 2-77381, thereby instantaneously measuring a supply rate of the waste 3. In this case, the detection signal is output every millisecond, and the supply rate is measured in units of seconds, so that a combustion control operation is performed by a a combustion control unit 11. An incinerator internal pressure is input from a detector 18 to the combustion control unit 11.

A control signal from the control unit 11 is output to the dust feeder 4, a blower 7 for supplying fluidizing air 16, a blower 8 for supplying secondary air 15 to a free board portion 13, and an induced blower 9 for exhaust gas 14. A tube 17 is branched from the fluidized air 16 to the free board portion 13, an ON/OFF valve 17*a* is arranged in the tube 17, and the control signal from the control unit 11 is output to the ON/OFF valve 17*a*. The dust feeder 4, the fluidizing air blower 7, the ON/OFF valve 17*a*, and the secondary air blower 8 or the induced blower 9 are selectively controlled in accordance with the nature of the waste 3.

Figure 2A:
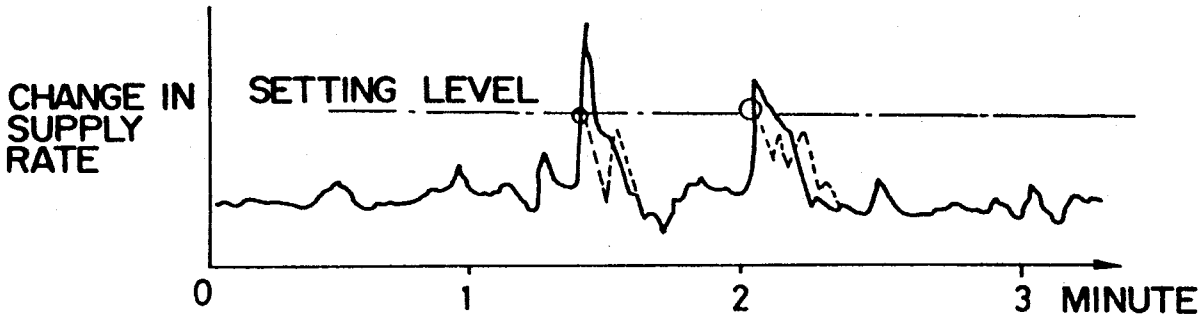
FIGS. 2A, 2B, and 2C are graphs for explaining changes in supply rate, incinerator internal pressure, and oxygen concentration of exhaust gas as a function of time, respectively.
Figure 2B:
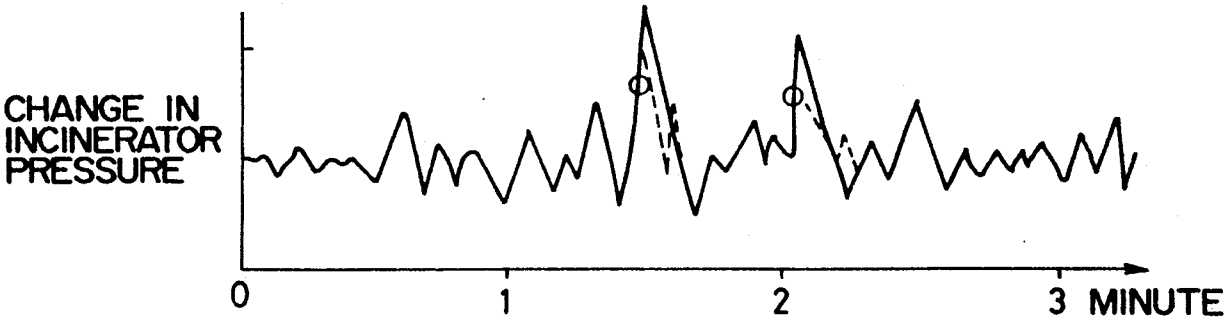
Figure 2C:
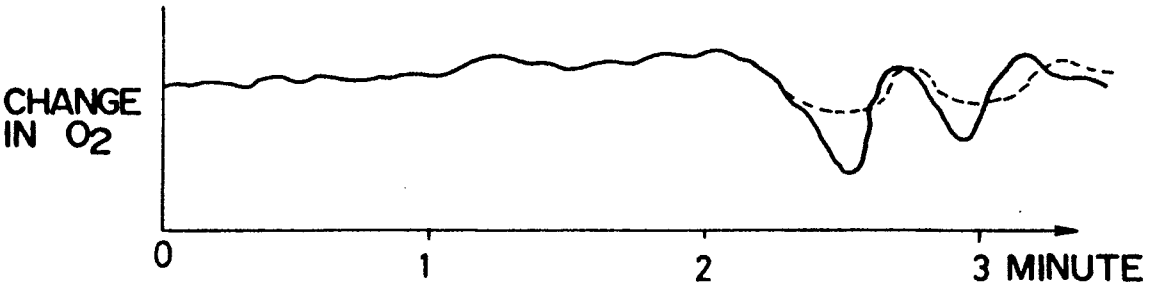
Figure 3:
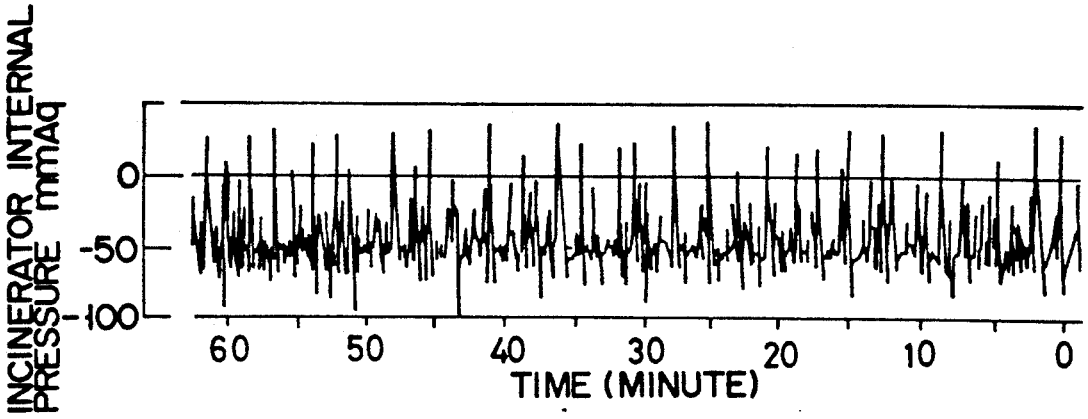
FIG. 3 is a graph for explaining a change in incinerator internal pressure as a function of time when a combustion control operation is performed by a conventional method.

In a conventional method, as shown in FIG. 2A, when waste is supplied at a flow rate exceeding to a rated value, an overloaded combusting operation is performed in the incinerator, the incinerator pressure is increased as shown in FIG. 2B. An unburnt gas may be produced by a lack of combustion air, and as shown in FIG. 2C, an oxygen concentration of an exhaust gas is sharply decreased.

In this case, the supply rate of waste is measured by the measuring unit 10, and the dust feeder 4, the secondary air blower 8, the induced blower 9, and the like are controlled by the control unit 11.

For example, as shown in FIG. 2A, when a supply rate exceeds a predetermined level, the dust feeder 4 is stopped for a predetermined period, and the secondary air blower 8 is controlled to increase a secondary air flow rate for a predetermined period. At the same time, the induced blower 9 is controlled to increase an exhaust gas inducing rate. Therefore, strong combusting is prevented, and a stable supply rate, a stable incinerator pressure, and a stable oxygen concentration indicated by broken lines of FIGS. 2A, 2B, and 2C, respectively, can be obtained. As a result, harmful gas components of the exhaust gas are prevented from exhaust out of the incinerator.

When municipal waste (Hu=2,000 Kcal/kg) is incinerated, operation results obtained in cases wherein the combustion control operation of the present invention is performed and not performed are shown in FIGS. 3 to 6.

A supply rate was measured by a measuring unit using a photoelectric element, and a waste supply rate was instantaneously measured on the basis of a detection signal from the measuring unit. A combustion control operation was performed so as to control the dust feeder 4, the fluidizing air blower 7, the secondary air blower 8, and the induced blower 9 (except for an operation of the ON/OFF valve 17*a*). The incinerator was operated to set an incinerator internal pressure at −50 mmAq.

A combustion control operation was performed by, e.g., an oxygen concentration of an exhaust gas and the incinerator internal pressure without using a waste supply rate measuring unit. As a result, a change in incinerator internal pressure and a change in CO gas concentration shown in FIGS. 3 and 5 were obtained.

Figure 4:
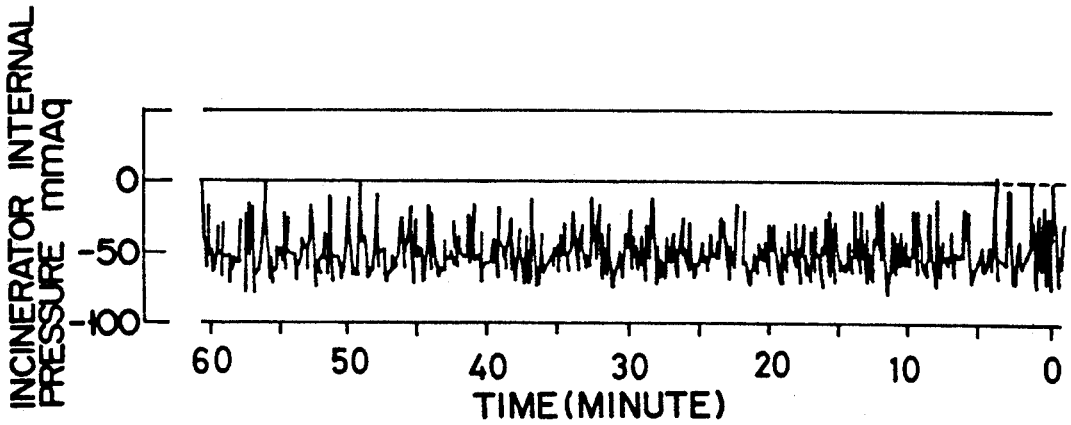
FIG. 4 is a graph for explaining a change in incinerator internal pressure as a function of time when a combustion control operation is performed by the method according to the present invention.
Figure 5:
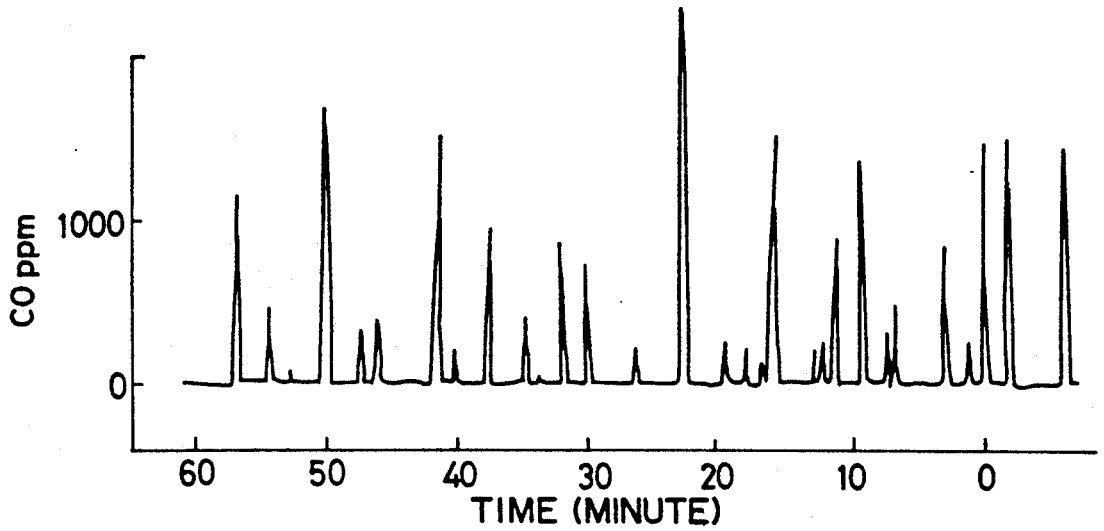
FIG. 5 is a graph for explaining a change in CO concentration as a function of time when a combustion control operation is performed by the conventional method.
Figure 6:
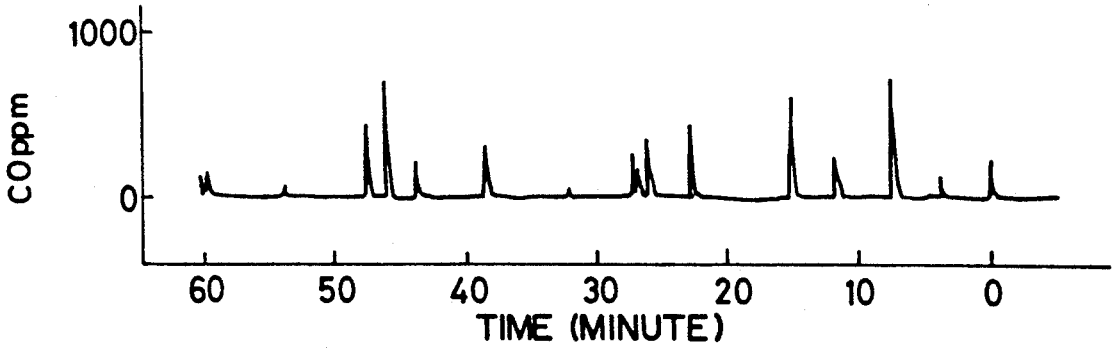
FIG. 6 is a graph for explaining a change in CO concentration as a function of time when a combustion control operation is performed by the method according to the present invention.

When a combustion control operation was performed using a waste supply rate measuring unit, as shown in FIG. 4, a change in incinerator internal pressure was considerably decreased. In addition, as shown in FIG. 6, a CO gas concentration was considerably reduced.

As described above, since the waste supply rate was measured using the waste supply rate measuring unit to perform the combustion control operation, production of an unburnt gas can be substantially prevented, a change in incinerator internal pressure could be suppressed. Therefore, a possibility of the incinerator internal pressure being a positive pressure could be extremely reduced.

The second embodiment wherein a combustion control operation is performed while controlling an ON/OFF valve 17*a* will be described below.

The first, second, and third control steps are performed by a combustion control unit 11 in accordance with a supply rate of waste. The first, second, and third control steps are performed when the supply rates are set at predetermined values of, e.g., 120%, 150%, and 200%, respectively.

In the first control step having a supply rate slightly higher than the predetermined value, a flow rate of secondary air 15 is increased, a set value of an incinerator internal pressure is decreased, and an exhaust gas induction rate is increased. Therefore, production of an unburnt gas is prevented, and an increase in incinerator internal pressure is prevented in advance. In the second control step having a supply rate considerably higher than the predetermined value, in addition to the operations of the first control step, the ON/OFF valve 17*a* arranged in a tube 17 connected to a free board portion 13 is opened. For this reason, fluidizing air 16 flows as secondary combustion air to the free board portion 13 having low air resistance, and the former fluidizing air flowing to a fluidized bed 6 is instantaneously decreased. Thus, a combusting operation on the fluidized bed 6 is suppressed, and an unburnt gas produced in this combustion operation is combusted in the free board portion 13. Finally, the third control step having a flow rate extremely higher than the predetermined value, the operation of the dust feeder 4 is stopped for a predetermined time.

After the above operations of these steps are performed, when a predetermined time has elapsed, the incinerator internal pressure is stabled. At this time, these controls item are set to their initial states.

Figure 7A:
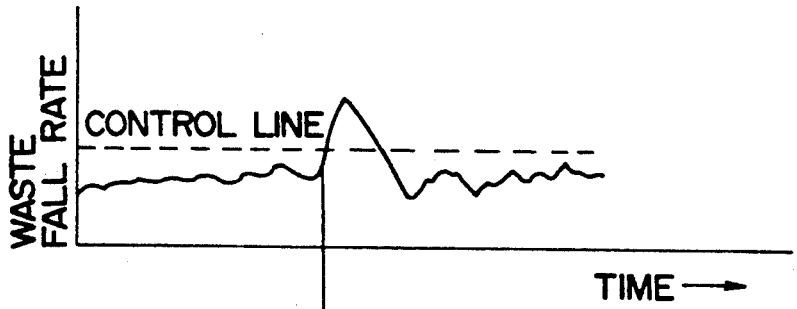
FIGS. 7A, 7B, and 7C are graphs for explaining changes in supply rate, control signal, and flow rate of fluidizing air as a function of time, respectively, according to the second embodiment of the present invention.
Figure 7B:
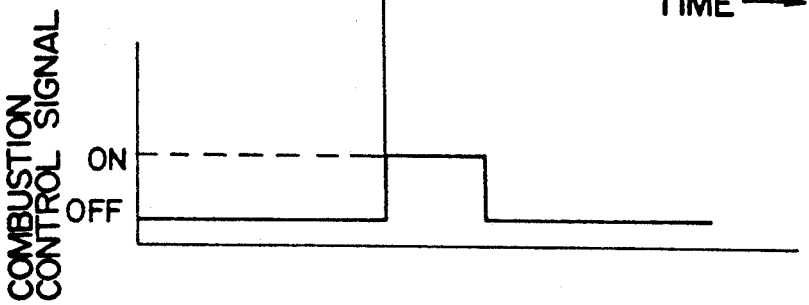
Figure 7C:
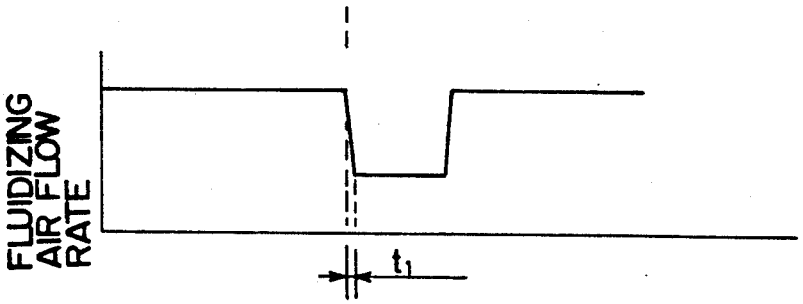

Operations in the second step will be described below with reference to FIGS. 7A to 7C.

(a) When a supply rate of combustion materials exceeds a predetermined level, (b) a signal for opening the ON/OFF valve 17*a* of the branch tube 17 is generated by the combustion control unit 11. Therefore, fluidizing air flows from the branch tube 17 to the free board portion, and (c) a fluidizing air flow rate is almost instantaneously (t1) reduced.

When the supply rate is decreased to the predetermined level or less, a predetermined time has elapsed, and the incinerator internal pressure is at the preset level or a lower level (not shown), the control items are set to their initial states.

Figure 7D:
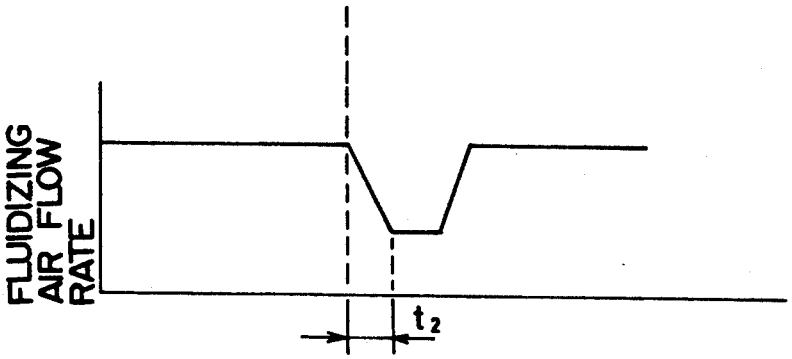
FIG. 7D is a graph for explaining a change in flow rate of fluidizing air as a function of time in the conventional method.

In this case, when the fluidizing air flow rate is controlled by a damper arranged in a tube 16, since the operation of the damper takes time, as shown in FIG. 7D, it takes time (t2) that the fluidizing air flow rate is decreased by a predetermined value. Since a time difference between t2 and t1 is generally 4 to 8 seconds, the control operation performed by the damper has a time lag, and a preferable control operation cannot be performed.

The second embodiment will be described in detail below.

Various elements set during a normal operation will be described as follows. An incinerator internal pressure is set at −70 mmAq; a flow rate of the fluidizing air 16, 6,500 $Nm^3/h$ (in this case, a fluidization magnification is about 7); a flow rate of the secondary air 15, 6,000 $Nm^3/h$; and a flow rate of the branch tube 17, zero.

Various elements set during a combustion control operation will be described as follows. The incinerator internal pressure is set at −80 mmAq; the flow rate of the fluidizing air 16 is increased to 7,000 $Nm^3/h$; the ON/OFF valve 17*a* is opened; and the fluidizing air 16 flows in the branch tube 17 at a flow rate of 2,000 $Nm^3/h$. As a result, a flow rate of fluidizing air flowing from the bottom of the fluidized bed is to be 5,000 $Nm^3/h$. In this case, a fluidization magnification is to be about 5. Therefore, a combustion time can be increased to 3 to 6 times a normal combustion time, and a combusting operation can be weakly performed. In addition, the flow rate of the secondary air 15 is increased to 6,600 $Nm^3/h$.

Figure 8:
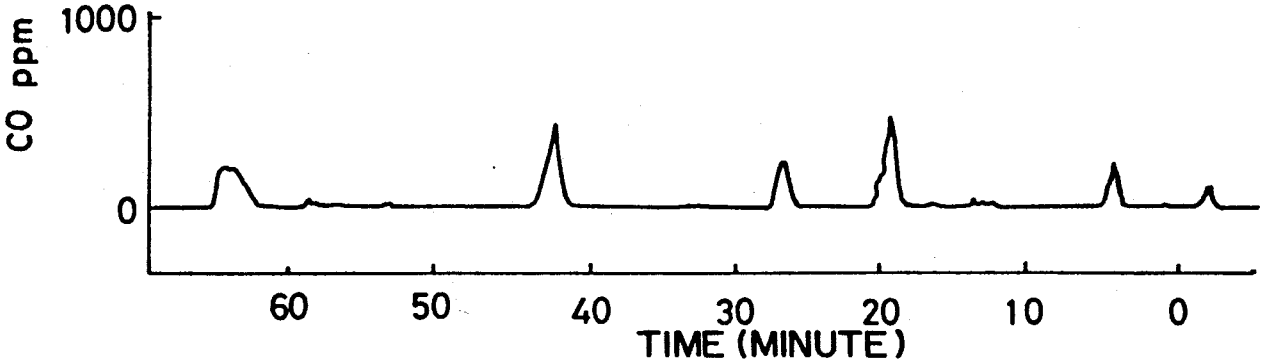
FIG. 8 is a graph showing a change in CO concentration as a function of time according to the second embodiment of the present invention.
Figure 9:
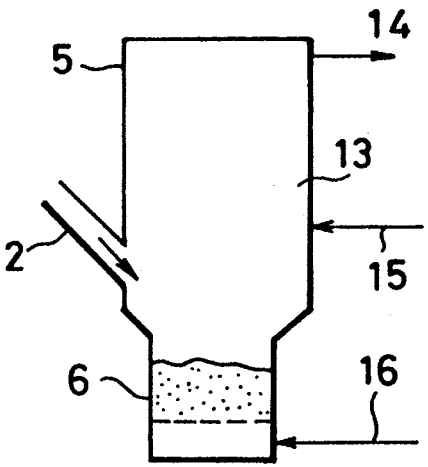
FIG. 9 is a view for explaining a fluidized-bed incinerator.

When municipal waste having a lower carolific value of about 2,000 kcal/kg is incinerated by the method of controlling combustion of the present invention, a change in CO concentration of the exhaust gas is shown in FIG. 8. The change in CO gas concentration is remarkably improved compared when a control operation of the ON/OFF valve 17*a* is not used as shown in FIG. 6.

According to the present invention, the CO concentration of the exhaust gas can be considerably reduced.

In the above embodiment, although a transmission photoelectric switch is used as a photoelectric element, a reflection photoelectric element, a laser transmission/-reception element, or the like can be used as the photoelectric element.

EFFECT OF THE INVENTION

A method of controlling combustion of a fluidized-bed incinerator according to the present invention has been described above. That is, since a waste supply rate is measured by a supply rate measuring unit arranged on a shoot for supplying incineration waste to an incinerator, before the waste is supplied to the incinerator, the waste supply rate can be instantaneously measured. Therefore, the fluidized-bed incinerator can be appropriately controlled in accordance with an incinerator combustion state changed by a change in supply rate of waste.

As described above, production of an unburnt gas is prevented, and a change in incinerator internal pressure is suppressed to extremely reduce a possibility that the incinerator internal pressure becomes a positive pressure, thereby performing a stable combustion control operation.

We claim:

1. A method for controlling combustion in a fluidized-bed incinerator comprising:

measuring a waste supply rate with a supply rate measuring unit, using a photoelectric element;

providing said supply rate measuring unit on a shoot for supplying at least one incineration waste product from a dust feeder to said incinerator; and wherein when, said measured waste supply rate in higher than a predetermined value, then decreasing a supply rate of said at least one incineration waste product provided from said dust feeder to suppress a combusting operation of said incinerator.

2. A method for controlling combustion in a fluidized-bed incinerator comprising:

measuring a waste supply rate with a supply rate measuring unit using a photoelectric element;

providing said supply rate measuring unit on a shoot for supplying at least one incineration waste product from a dust feeder to said incinerator; and wherein when, said waste supply rate is higher than a predetermined value, then increasing an induced gas flow rate of an exhaust gas induced blower of said incinerator to suppress an increase in an internal pressure of said incinerator.

3. A method for controlling combustion in a fluidized-bed incinerator comprising:

measuring a waste supply rate with a supply rate measuring unit using a photoelectric element;

providing said supply rate measuring unit on a shoot for supplying at least one incineration waste product from a dust feeder to said incinerator; and wherein when, said measured waste supply rate is higher than a predetermined value, then decreasing a flow rate of a fluidizing air of a forcing blower to suppress a combusting operation of said incinerator.

4. A method for controlling combustion in a fluidized-bed incinerator comprising;

measuring a waste supply rate with a supply rate measuring unit using a photoelectric element;

providing said supply rate measuring unit on a shoot for supplying at least one incineration waste product from a dust feeder to said incinerator; and wherein when, said measured waste supply rate is higher than a predetermined value, then increasing an air flow rate of a blower for supplying a quantity of air to a free board portion of said incinerator to prevent production of an unburnt gas.

5. A method for controlling combustion in a fluidized-bed incinerator comprising:

measuring a waste supply rate with a supply rate measuring unit using a photoelectric element;

providing said supply rate measuring unit on a shoot for supplying at least one incineration waste product from a dust feeder to said incinerator; and wherein when, said waste supply rate is higher than a predetermined value, then instantaneously decreasing a flow rate of a fluidizing air to suppress a combusting operation of said incinerator and at the same time, supplying a quantity of air to a free board portion of said incinerator so that said quantity of air has a flow rate corresponding to said decrease in said flow rate of said fluidizing air, to suppress said combustion operation and to prevent a production of an unburnt gas.

6. A method for controlling combustion in a fluidized-bed incinerator comprising:

measuring a waste supply rate with a supply rate measuring unit using a photoelectric element;

providing said supply rate measuring unit on a shoot for supplying at least one incineration waste product from a dust feeder to said incinerator; and wherein when, said waste supply rate is higher than a predetermined value, then controlling the fluidized-bed incinerator by a combination of not less than two of the following control operations;

decreasing a supply rate of said at least one incineration waste product provided from said dust feeder to suppress a combusting operation of said incinerator;

increasing an induced gas flow rate of an exhaust gas induced blower of said incinerator to suppress an increase in an internal pressure of said incinerator;

decreasing a flow rate of a first fluidizing air of a forcing blower to suppress said combusting operation of said incinerator;

increasing an air flow rate of a blower for supplying a quantity of air to a free board portion of said incinerator to prevent production of an unburnt gas; and instantaneously decreasing a flow rate of a second fluidizing air to suppress said combusting operation of said incinerator and at the same time, supplying said quantity of air to said free board portion of said incinerator so that said quantity of air has a flow rate corresponding to said decrease in said flow rate of said second fluidizing air, to prevent a production of said unburnt gas.

7. The method of claim 6, wherein combusting in said fluidized-bed incinerator is controlled by:

decreasing said supply rate of said at least one incineration waste product from said dust feeder to suppress said combusting operation of said incinerator; and increasing said induced gas flow rate of said exhaust gas induced blower of said incinerator to suppress said increase in said internal pressure of said incinerator.

8. The method of claim 6, wherein combusting in said fluidized-bed incinerator is controlled by:

decreasing a supply rate of said at least one incineration waste product from said dust feeder to suppress said combusting operation of said incinerator; and decreasing said flow rate of said first fluidizing air of said forcing blower to suppress said combusting operation of said incinerator.

9. The method of claim 6, wherein combusting in said fluidized-bed incinerator is controlled by:

decreasing said supply rate of said at least one incineration waste product from said dust feeder to suppress said combusting operation of said incinerator; and increasing said air flow rate of said blower for supplying said quantity of air to said free board portion of said incinerator to prevent production of said unburnt gas.

10. The method of claim 6, wherein combusting in said fluidized-bed incinerator is controlled by:

decreasing said supply rate of said at least one incineration waste product from said dust feeder to suppress said combusting operation of said incinerator; and instantaneously decreasing said flow rate of said second fluidizing air to suppress said combusting operation of said incinerator, and at the same time, supplying said quantity of air to said free board portion of said incinerator so that said quantity of air has said flow rate corresponding to said decrease in said flow rate of said second fluidizing air, to prevent said production of said unburnt gas.

11. The method of claim 6, wherein combusting in said fluidized-bed incinerator is controlled by:

increasing said induced gas flow rate of an exhaust gas induced blower of said incinerator to suppress said increase in said internal pressure of said incinerator; and decreasing said flow rate of said first fluidizing air of said forcing blower to suppress said combusting operation of said incinerator.

12. The method of claim 6, wherein combusting in said fluidized-bed incinerator is controlled by:

increasing said induced gas flow rate of said exhaust gas induced blower of said incinerator to suppress said increase in said internal pressure of said incinerator; and increasing said air flow rate of said blower for supplying said quantity of air to said free board portion of said incinerator to prevent production of said unburnt gas.

13. The method of claim 6, wherein combusting in said fluidized-bed incinerator is controlled by:

increasing said induced gas flow rate of said exhaust gas induced blower of said incinerator to suppress said increase in said internal pressure of said incinerator; and instantaneously decreasing said flow rate of said second fluidizing air to suppress said combusting operation of said incinerator, and at the same time, supplying said quantity of air to said free board portion of said incinerator so that said quantity of air has said flow rate corresponding to said decrease in said second flow rate of said fluidizing air, to prevent said production of said unburnt gas.

14. The method of claim 6, wherein combusting in said fluidized-bed incinerator is controlled by:

decreasing said flow rate of said first fluidizing air of said forcing blower to suppress said combusting operation of said incinerator; and increasing said air flow rate of said blower for supplying said quantity of air to said free board portion of said incinerator to prevent production of said unburnt gas.

15. The method of claim 6, wherein combusting in said fluidized-bed incinerator is controlled by:

decreasing said flow rate of said first fluidizing air of said forcing blower to suppress said combusting operation of said incinerator; and instantaneously decreasing said flow rate of said second fluidizing air to suppress said combusting operation of said incinerator, and at the same time, supplying said quantity of air to said free board portion of said incinerator so that said quantity of air has said flow rate corresponding to said decrease in said flow rate of said second fluidizing air, to prevent said production of said unburnt gas.

16. The method of claim 6, wherein combusting in said fluidized-bed incinerator is controlled by:

increasing said air flow rate of said blower for supplying said quantity of air to said free board portion of said incinerator to prevent production of said unburnt gas; and instantaneously decreasing said flow rate of said second fluidizing air to suppress said combusting operation of said incinerator, and at the same time, supplying said quantity of air to said free board portion of said incinerator so that said quantity of air has a flow rate corresponding to said decrease in said flow rate of said second fluidizing air, to prevent said production of said unburnt gas.

* * * * *